US009033830B2

(12) United States Patent
Khan

(10) Patent No.: US 9,033,830 B2
(45) Date of Patent: May 19, 2015

(54) CRICKET BAT

(71) Applicant: Mark Khan, Little Falls, NJ (US)

(72) Inventor: Mark Khan, Little Falls, NJ (US)

( * ) Notice: Subject to any disclaimer, the term of this patent is extended or adjusted under 35 U.S.C. 154(b) by 183 days.

(21) Appl. No.: 13/652,539

(22) Filed: Oct. 16, 2012

(65) Prior Publication Data

US 2013/0337947 A1 Dec. 19, 2013

Related U.S. Application Data

(60) Provisional application No. 61/660,908, filed on Jun. 18, 2012, provisional application No. 61/660,912, filed on Jun. 18, 2012.

(51) Int. Cl.

| | |
|---|---|
| ***A63B 59/18*** | (2006.01) |
| ***A63B 59/08*** | (2006.01) |
| ***A63B 59/00*** | (2006.01) |

(52) U.S. Cl.

CPC ..... *A63B 59/08* (2013.01); *A63B 59/0088* (2013.01); *A63B 59/0055* (2013.01)

(58) Field of Classification Search

USPC ..... 273/407, 378, 127 R, 369, 390–392; 473/407, 422, 451, 457, 458, 565; 607/108

See application file for complete search history.

(56) References Cited

U.S. PATENT DOCUMENTS

| | | | | | |
|---|---|---|---|---|---|
| D19,673 | S | * | 3/1890 | Berger | D8/396 |
| 448,550 | A | * | 3/1891 | Scott et al. | 248/65 |
| 1,945,430 | A | * | 1/1934 | Garrett | 403/66 |
| 2,026,078 | A | * | 12/1935 | Walker | 294/32 |
| D145,524 | S | * | 9/1946 | Hoffman | D8/10 |
| 3,273,839 | A | * | 9/1966 | Bennett | 248/73 |
| 4,186,923 | A | * | 2/1980 | Garner et al. | 473/565 |
| 5,816,963 | A | * | 10/1998 | Brooks et al. | 473/564 |
| 6,138,879 | A | * | 10/2000 | Breuner | 223/78 |
| 2013/0043368 | A1 | * | 2/2013 | Hill | 248/534 |
| 2013/0337947 | A1 | * | 12/2013 | Khan | 473/565 |

FOREIGN PATENT DOCUMENTS

GB 2479570 A * 10/2011

OTHER PUBLICATIONS

Web page download, UKAbswers, 2007, https://uk.answers.yahoo.com/question/index?qid=20070710044518AATm9rt, 5 pages.*
Webpage download, Amazon2010, 2010, http://www.amazon.com/gp/product/B002JPJ0QY/, 2 pages.*
Webpage download, ShiftSports, 2014, www.facebook.com/pages/Shift-Sports/1435747313365019?, 5 pages.*

* cited by examiner

*Primary Examiner* — Gene Kim
*Assistant Examiner* — M Chambers
(74) *Attorney, Agent, or Firm* — Gearhart Law, LLC

(57) ABSTRACT

A cricket bat in which the striking surface is off-set a distance of 1-2 cm from the front-line of the handle is disclosed. The bat may conform to the relevant Laws of Cricket, having a flat striking surface; a blade made of wood, 10.8 cm or less in width, and when combined with a handle, made mostly of cane, 96.5 cm or less in length. The handle is 52% or less of the bat's total length. In other versions, the bat may not conform to the Laws of Cricket, may be modular in construction and made of aluminum, glass or carbon fiber, a suitable plastic, or some combination of such materials. The blade and the handle may be joined by screw-attached brackets making the components interchangeable, allowing for customization of bat size, weight, length, color and decoration.

6 Claims, 5 Drawing Sheets

CRICKET BAT

CLAIM OF PRIORITY

This application claims priority to U.S. Ser. No. 61/660908 entitled "Off-set handle cricket bat" filed on Jun. 18, 2012, and to U.S. Ser. No. 61/660,912 entitled "Modular Construction Cricket Bat System" filed Jun. 18, 2012 the contents of both of which are hereby fully incorporated herein by reference.

FIELD OF THE INVENTION

The invention relates to a cricket bat, and more particularly to cricket bats having a striking surface offset forward from a front line of a handle, and to cricket bats constructed from modular wood and non-wood materials.

BACKGROUND OF THE INVENTION

The game of Cricket is a traditional British past time, having roots that go back as far as King Edward II (1307-1327), although the earliest definitive reference to cricket occurs in a 1598 court record mentioning that "creckett" was played on common ground in Guilford, Surry by school boys. The first recorded accounts of adults playing cricket occur in the early 1600's, with one account being a coroner's court record of the death of a cricket player, Jasper Vinall, who was killed while fielding when he was struck on the head by a ball. The verdict was death by "misadventure".

Cricket is now the primary summer sport in most of the countries that constituted the Victorian British Empire, including Australia, New Zealand, India, Pakistan, the West Indies, South Africa and the British Isles.

Cricket is a bat-and-ball game, with the dimensions and construction of the bat being of particular concern. Since its formation in 1787, the Marylebone Cricket Club (MCC) has been recognized as the sole authority for drawing up the governing rules of cricket, known as the Laws of Cricket.

Law 6 and Appendix E of the Laws of Cricket govern the materials and dimensions of a cricket bat. The currently applicable edition of the relevant laws are attached as Appendix A and B, and are both hereby incorporated by reference into this application. These laws state, amongst other matters, that a cricket bat is to be made of two parts: the handle and the blade, and that the combined length of the blade and the handle shall be no more than 38 inches (965 mm), and the width of the bat shall be no more than 4.25 inches (108 mm). A typical cricket bat weighs between 1.1 to 1.4 kg, but there is no standard limiting the weight. The laws also state that the handle is to be made principally of cane and/or wood that may be in laminar form and may be glued where necessary and bound with twine along its upper portion. The blade must consist solely of solid wood. No material may be inserted into either the blade or the lower portion of the handle.

In addition to regulation cricket, the game is also played by children and adults in informal situations in which the rules and the equipment used may differ from those of regulation cricket. There are countless variations of informal cricket, such as, but not limited to, indoor cricket, street cricket, backyard cricket, beach cricket, modified cricket, such as continuous cricket and French Cricket.

Indoor cricket is a modified form of the sport played in an indoor "court" that contains a cricket pitch of standard dimensions, covered with artificial turf, and is usually played with regulation cricket bats and a regulation cricket ball. Indoor cricket is played in organized amateur competitions and as a casual sport amongst groups of friends. The organized indoor cricket competitions are typically governed by the rules promulgated by the World Indoor Cricket Federation. These stipulate, for instance, that bats must be made of wood and have a maximum height of 96.5 cm and a maximum width of 10.8 cm, i.e., the same materials and maximum dimensions as in traditional cricket, though indoor cricket bats tend to be lighter as the ball used is typically a modified standard cricket ball having a softer center. Outside of organized tournaments, however, the equipment used may be at the discretion of the players.

Street cricket is a form of cricket played informally, generally by children in which a street (or school playground, or park) forms the pitch and playing area. The game is generally played with a tennis ball instead of a cricket ball, though older children or adults may play with a tennis ball covered in plastic tape, to make it a bit harder, or even half-covered with tape, allowing the ball to swing. Bats used may range from regulation bats to hand fashioned planks of wood.

Backyard cricket is an even more informal form of cricket, usually played by adults during the early stages of a barbecue when the fire is just warming up. Many of the same rules of street cricket and similar equipment may be used.

Beach cricket is essentially either street cricket or backyard cricket with the additional feature of a playing surface ideal for spectacular diving catches. Fielding in the surf is a coveted position on hot days.

Several forms of modified cricket have been developed with the intention of allowing children to develop sporting skills These include continuous cricket, which is really a family of related games, all characterized by the rule that batsmen may not be run out, but the bowler may bowl the ball as soon as he is ready, without waiting for the batsmen to be ready, or even to have completed a run. This sort of cricket is usually played in a mad frenzy. The ball is typically a tennis or cork ball, and the bats are any suitable bats that are available.

French cricket is perhaps the most informal of all, and may be played with just a single cricket bat, made of no specific materials and having no specific dimensions, and a tennis ball. There are typically no pitch and no wickets. The batsman must stand with his feet planted together on the ground and not move them—if the feet move or he falls over he is out. The aim of the fielders is to hit the batsman's legs—doing so results in him being out.

DESCRIPTION OF THE RELATED ART

The relevant prior art includes:

US Patent Application no. 20110143871 filed by M. C. Fernandez on Jun. 16, 2011 entitled "Cricket Sports Bat" that describes a cricket sports bat having an elongated handle and a truncated blade, the blade having a front playing face the majority of which is substantially planar across its face, an opposing rear surface, sides extending between the front face and rear surface, a toe and a pair of shoulders extending one each side of the handle/blade to the sides, characterized in that the ratio of the length of the blade to the width of the blade is in the range of 4:1-3.25:1. This invention relates to a bat for use in cricket.

U.S. Pat. No. 4,186,923 granted to Garner, et al. on Feb. 5, 1980 entitled "Cricket bat" that describes a method of extending the sweet spot of the blade of a cricket bat. To do this, the blade has a depression or depressions in its rear surface. These depressions are arranged and/or dimensioned and/or positioned so that the blade is of maximum thickness at, or adjacent to, the periphery of the blade.

Various implements are known in the art, but fail to address all of the problems solved by the invention described herein. Various embodiments of this invention are illustrated in the accompanying drawings and will be described in more detail herein below.

SUMMARY OF THE INVENTION

The present invention concerns an off-set cricket bat in which the striking surface of the bat's blade is off-set ahead of a front-line of a handle of the bat, and which may be modular in construction so that the blade and handle may be interchangeable.

In a preferred embodiment, the cricket bat of the present invention conforms to the relevant Laws of Cricket regarding a cricket bat, as published by the Marylebone Cricket Club (MCC) in 2010 and appended to this application. In particular, the cricket bat blade may have a substantially flat striking surface that may have a maximum width of 10.8 cm, both the handle and blade may be made primarily of wood and the total length of the combined handle and blade may be 96.5 cm or less, with the handle being 52% or less of the total length of the bat.

In a preferred embodiment, the off-set between the striking surface of the blade and a front line of the handle may be at least 1 cm, and is preferably a distance of 1.27 cm +/−0.2 cm.

In a preferred embodiment, the handle may have a cylindrical upper portion and a V-shaped lower portion. The V-shape lower portion of the handle may be joined to a corresponding V-shaped cut-out in the upper portion of the blade of the bat, and may be secured by adhesive bonding. The V-shape preferably subtends an angle of 25 degrees or less.

In a further preferred embodiment of the invention, the components may be modular, allowing for customization of a bat. The handle and blade may be made of any suitable material such as, but not limited to, aluminum, chrome, steel, stainless steel, plastic, carbon fiber, glass fiber, bamboo or wood, or a combination thereof, and may be solid or hollow or a combination thereof. The blade and the handle may be joined by any suitable temporary or permanent bonding method such as, but not limited to, clamps, brackets, screws, adhesives, or some combination thereof. The dimensions of the bat may conform to the relevant Laws of Cricket, or may diverge from them.

In another preferred embodiment of the invention, the blade may have its center of gravity adjusted by having cut-outs in all or a portion of the bat blade. The cut-outs may traverse the entire width of the blade, or may be blind cut-outs that traverse only a portion of the width of the blade or some combination thereof.

In the another preferred embodiment of the invention, the blade may instead or in addition have a thickened portion that may be situated in the lower portion of the blade.

Therefore, the present invention succeeds in conferring the following, and others not mentioned, desirable and useful benefits and objectives.

It is an object of the present invention to provide a cricket bat that affords a batman an increased window of opportunity to strike an approaching ball.

It is another object of the present invention to provide an improved balance to a cricket bat.

Yet another object of the present invention is to provide a cricket bat that is modular in construction.

Still another object of the present invention is to provide a cosmetically customizable bat.

Still another object of the present invention is to provide a customizable bat that has interchangeable blades of varying shape, weights and color.

Yet another object of the present invention is to provide blades having a customizable center of gravity.

BRIEF DESCRIPTION OF THE DRAWINGS

FIG. 1 B shows a front view of a traditional, cricket law compliant cricket bat.

FIG. 1 C shows a side view of a traditional, cricket law compliant cricket bat.

FIG. 2 B shows a front view of a cricket law compliant off-set handle bat.

FIG. 2 C shows a side view of a cricket law compliant off-set handle bat.

FIG. 3 B shows a front perspective view of a cricket law compliant off-set handle bat.

FIG. 4 B shows a front view of an off-set handle bat.

FIG. 4 C shows a back view of an off-set handle bat.

FIG. 4 D shows a side view of an off-set handle bat.

FIG. 4 E shows a close-up, back view of a bracket fixing the handle to the blade.

FIG. 4 F shows a close-up, top view of a bracket fixing the handle to the blade.

FIG. 5 B shows a front view of a perforated off-set handle bat.

FIG. 5 C shows a back view of a perforated off-set handle bat.

FIG. 5 D shows a side view of a perforated off-set handle bat.

FIG. 6 B shows a front view of a partially-perforated off-set handle bat.

FIG. 6 C shows a back view of a partially-perforated off-set handle bat.

FIG. 6 D shows a side view of a partially-perforated off-set handle bat.

FIG. 7 B shows a front view of a thickened lower blade off-set handle bat.

FIG. 7 C shows a back view of a thickened lower blade off-set handle bat.

FIG. 7 D shows a side view of a thickened lower blade off-set handle bat.

1946 MK 02 UTL

DESCRIPTION OF THE PREFERRED EMBODIMENTS

Figure 1A:
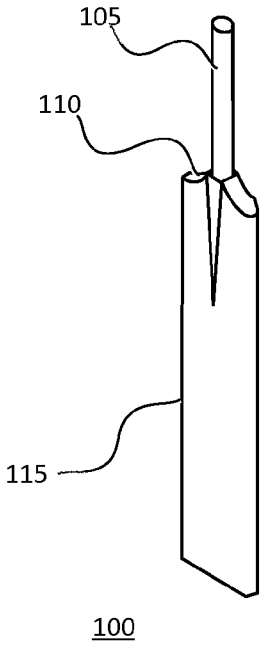
FIG. 1 A shows a perspective view of a traditional, cricket law compliant cricket bat.

The preferred embodiments of the present invention will now be described with reference to the drawings. Identical elements in the various figures are identified with the same reference numerals.

Various embodiments of the present invention are described in detail. Such embodiments are provided by way of explanation of the present invention, which is not intended to be limited thereto. In fact, those of ordinary skill in the art may appreciate upon reading the present specification and viewing the present drawings that various modifications and variations can be made thereto.

Figure 1B:
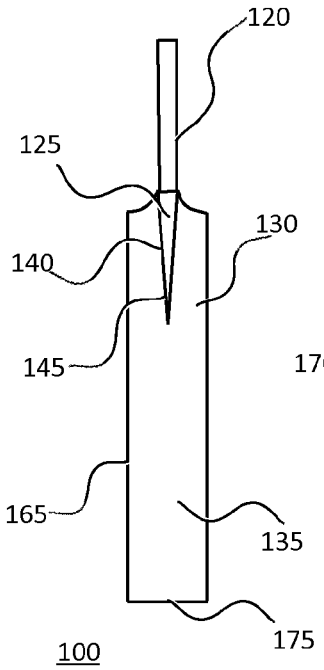
Figure 1C:
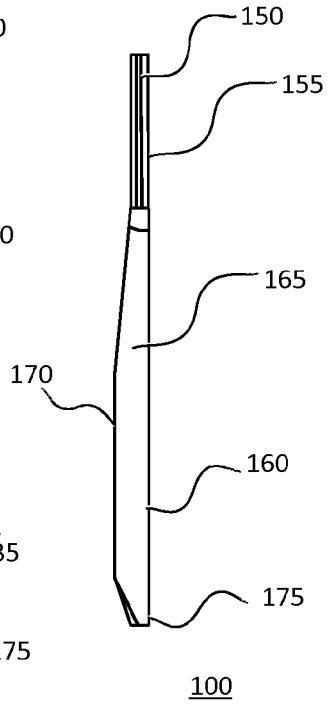

FIG. 1 A shows a perspective view of a traditional, cricket law compliant cricket bat. The traditional, cricket law compliant cricket bat includes a cricket bat blade 115 that has a shoulder 110 and a handle 105.

As shown in FIG. 1 B, which is a front view of a traditional cricket bat, although the cricket bat handle 105 is made from a single piece of wood, it has two distinct parts, the upper portion of the handle 120 and the lower portion of the handle 125. The upper portion of the handle 120 is cylindrically shaped and is the part of the bat that a batsman grips. The lower portion of the handle 125 is typically V-shaped and is traditionally glued into a corresponding V-shaped slot in the blade 115 so as to form a complete bat.

As shown in FIGS. 1 A, 1 B and 1 C, the parts of a traditional cricket bat may include shoulders 110, an upper portion of the blade 130, a V-shaped lower handle 140, a V-shaped cut out in the upper blade 145, two sides of the blade 165, a lower portion of the blade 135, a toe of the blade 175, a back of the blade 170 and a face or striking surface of the blade 160. The cricket bat handle 105 may, in the upper portion of the handle 120 have a laminated non-wood insert 150. The laminated non-wood insert 150 typically helps reduce vibrations transmitted to the batsman's hands when the face of the blade 160 strikes a ball.

Bats used in first class cricket are currently required to conform to Law 6, and the associated Appendix E, of the Laws of Cricket as published by the Marylebone Cricket Club, London, England, on Oct. 1, 2010 as "2000 Code 4th Edition—2010".

This law and appendix provide that, amongst other details, the bat must have a substantially flat striking surface that has a maximum width of 10.8 cm (4¼ inches), that both the handle and blade be made primarily of wood and that the total length of the combined handle and blade is 96.5 cm (38 inches) or less. In addition, the handle must be 52% or less of the total length of the bat.

As can be seen clearly in FIG. 1 C, the front line of handle 155 of a traditional cricket bat is in-line with a plane containing the face of the blade 160.

One preferred embodiment of the present invention is a cricket law compliant bat in which the font line of the handle is off-set behind the plane of the face of the blade.

Figure 2A:
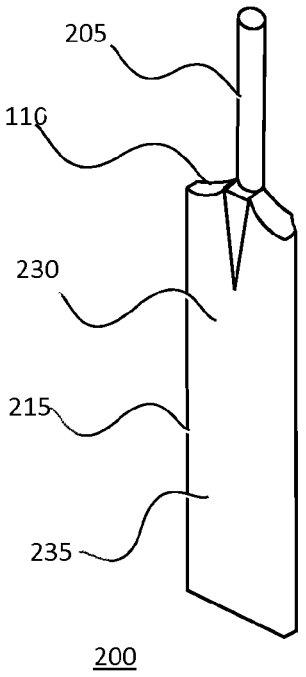
FIG. 2 A shows a perspective view of a cricket law compliant off-set handle bat.
Figure 2B:
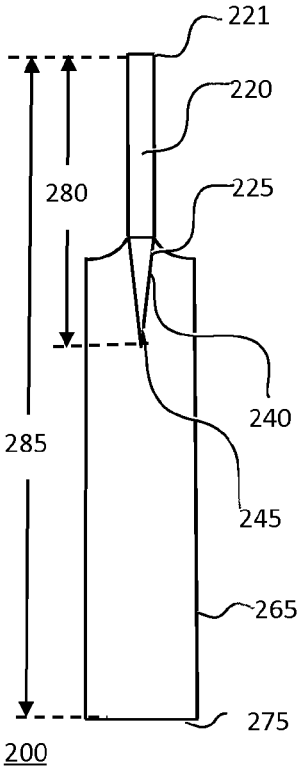
Figure 2C:
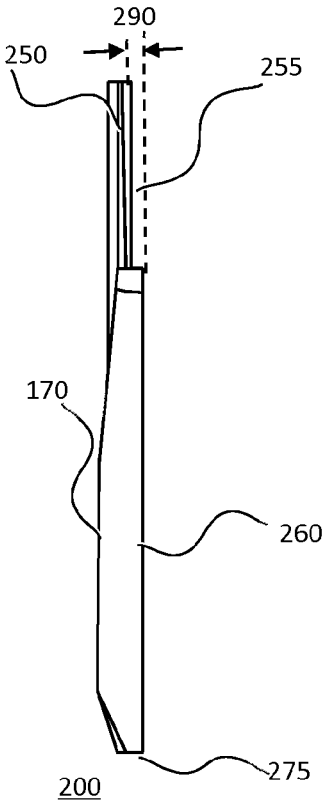

FIG. 2 A shows a perspective view of a cricket law compliant off-set handle bat 200. The cricket law compliant off-set handle bat 200 may include a handle 205 and a blade 215, both made of the materials stipulated by Law 6, i.e., the blade made of wood, typically English (white) or Kashmir willow, and the handle made principally of cane or wood. The off-set handle cricket bat blade 215 may be similar to the blade 115 of a traditional, cricket law compliant cricket bat and may have shoulders 210, an upper portion of the blade 230 and a lower portion of the blade 235.

FIG. 2 B shows a front view of a cricket law compliant off-set handle bat 200. In this view it may be seen that, like a traditional, cricket law compliant bat, the handle may have an upper portion 220 and a lower portion 225. Moreover, the lower portion of the handle may also be V-shaped and may be shaped and sized to fit a complementary V-shaped cut out in the upper blade encrypted data encrypted data 245. The handle and the blade may, therefore, be joined by gluing the matching V-shapes together, as done in traditional, cricket law compliant cricket bats 100.

FIG. 2 B also shows that the cricket law compliant off-set handle bat 200 may have a toe 275 and sides 265. The length of the blade and attached handle 285 may be measured from the bottom or toe 275 of the bat to the top of the handle 221, and this length may conform to Law 6 by being 38 inches or less. The length of the handle 280 may be measured from the bottom of the V-shaped 240 lower portion of the handle 225 to the top of the handle 221 off-set handle cricket bat lower portion of the handle 225. To comply with Law 6, the length of the handle 280 may be limited to 52% or less of the combined length of the blade and attached handle 285.

FIG. 2 C shows a side view of a cricket law compliant off-set-handle bat 200.

As seen in FIG. 2 C, there may be an off-set distance between plane of the striking surface and the front-line of the handle 290.

In a preferred embodiment, the off-set 290 between the striking surface 260 of the blade, or the theoretical plane containing that striking surface, and a front line 255 of the handle may be at least 1 cm, and is preferably a distance of 1.27 cm +/−0.2 cm, as this degree of off-set appears, empirically, as providing what may be optimum batting performance with the bat such as, but not limited to, better balance, more power and a faster reaction time or some combination thereof.

The blade may, for instance, be made of a single piece of English or Kashmir willow that has been suitably pressure treated so as to be sufficiently hard to be able to strike a regulation cricket ball travelling at speeds up to 100 mph. The blade may then be shaped by well-known wood working techniques such as, but not limited to, cutting, planning, milling, filing or some combination thereof.

Figure 3A:
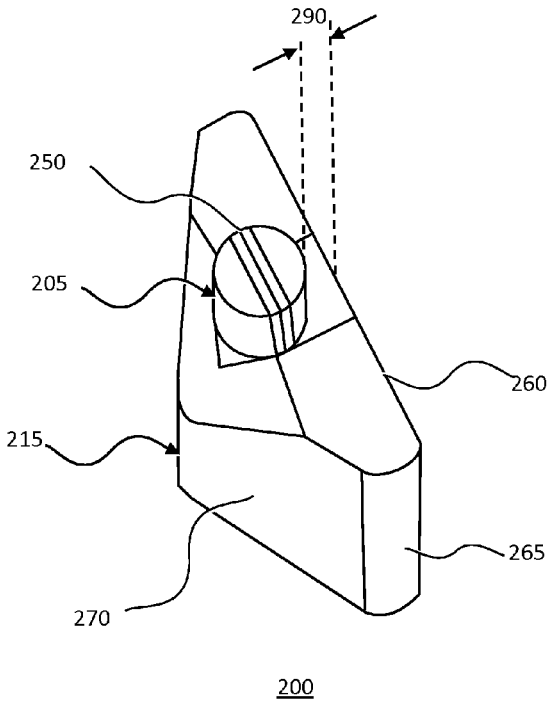
FIG. 3 A shows a rear perspective view of a cricket law compliant off-set handle bat.
Figure 3B:
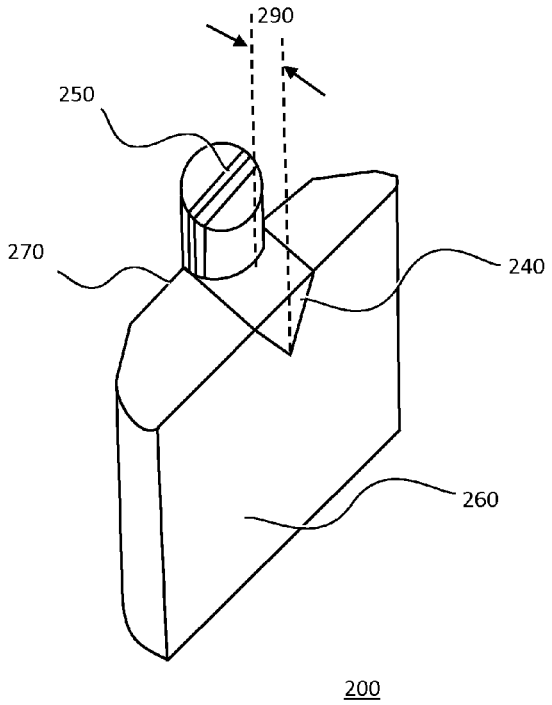
Figure 4A:
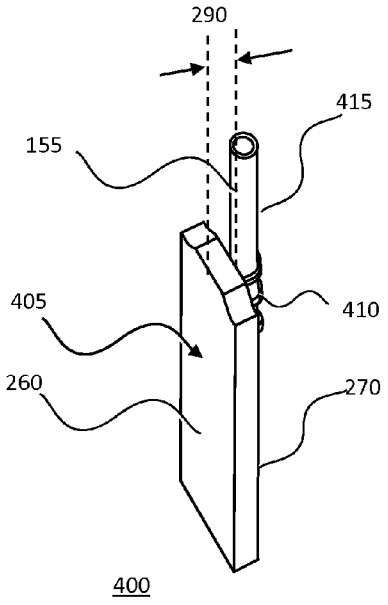
FIG. 4 A shows a perspective view of an off-set handle bat.
Figure 4B:
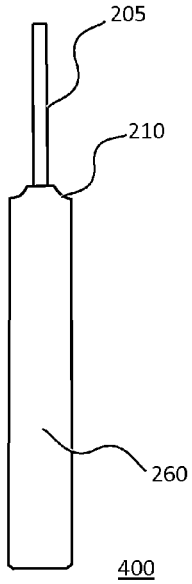
Figure 4C:
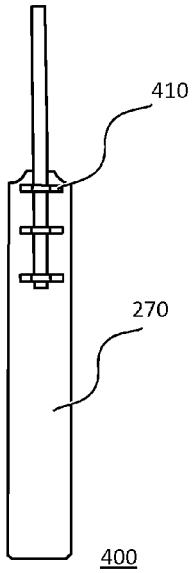
Figure 4D:
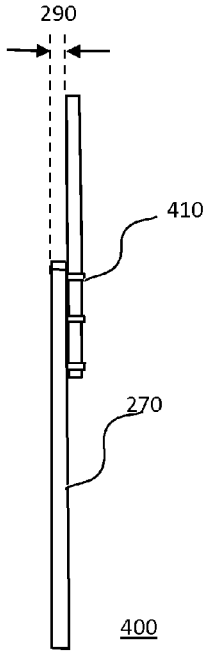
Figure 4E:
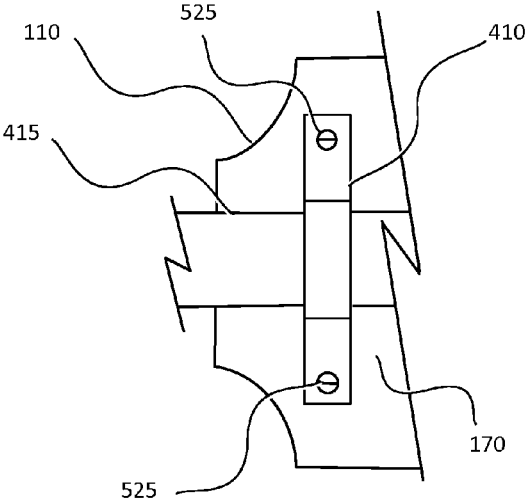
Figure 4F:
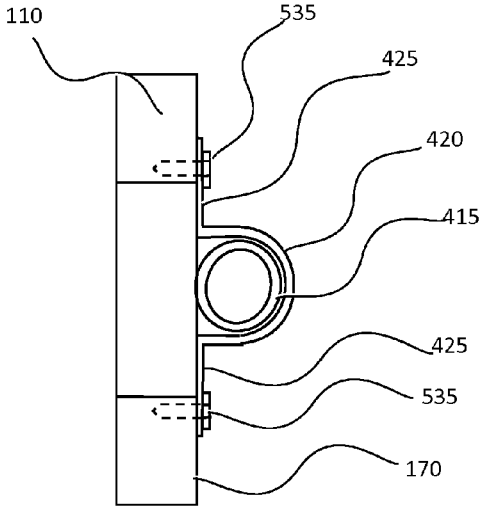
Figure 5A:
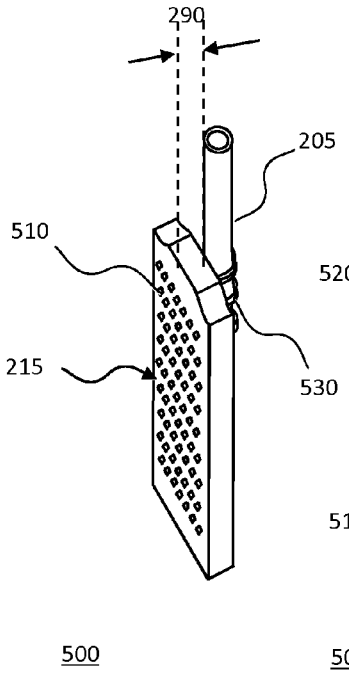
FIG. 5 A shows a perspective view of a perforated off-set handle bat.
Figure 5B:
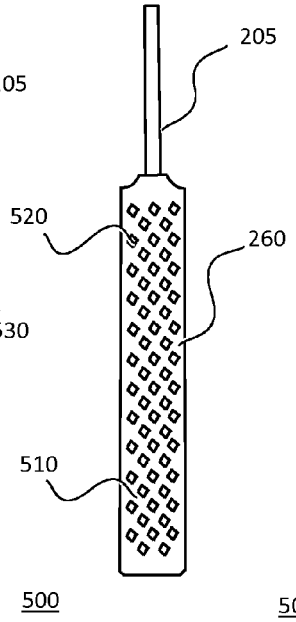
Figure 5C:
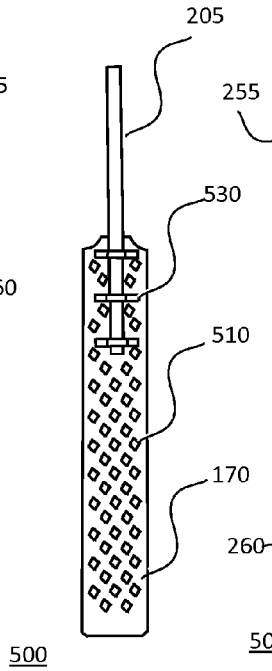
Figure 5D:
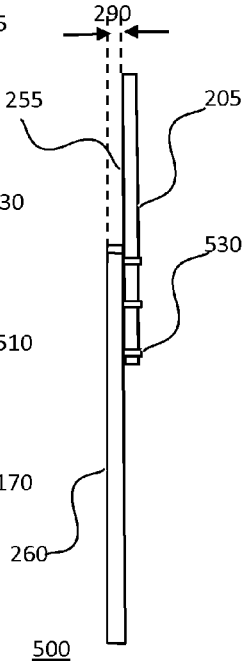
Figure 6A:
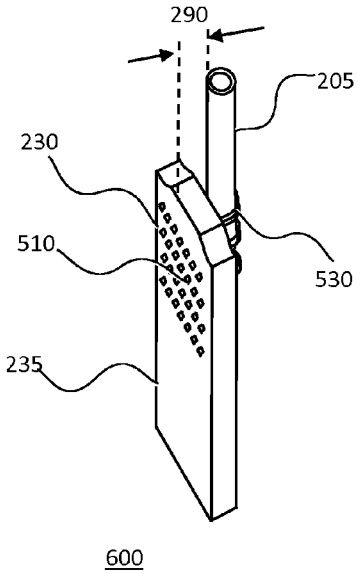
FIG. 6 A shows a perspective view of a partially-perforated off-set handle bat.
Figure 6B:
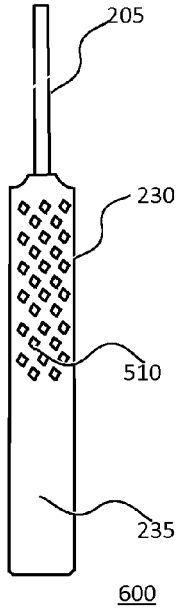
Figure 6C:
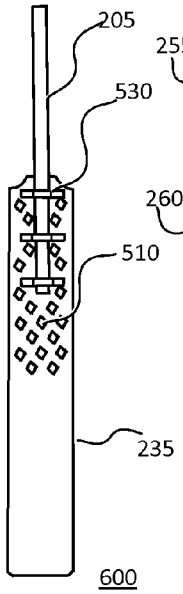
Figure 6D:
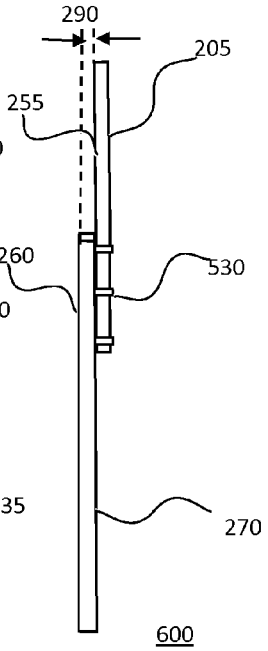

FIG. 3 A shows a rear perspective view of a cricket law compliant off-set-handle bat 200. Although this off-set may of any reasonable distance, it has been found empirically that an offset of 1-2 cm may provide an optimal performance of the bat.

In this view the off-set distance 290 between plane of the striking surface 260 and the front-line of the handle is shown clearly. This view also shows a laminated non-wood insert 250 that may be incorporated into the off-set handle cricket bat handle 205, primarily to improve the vibration handling characteristics of the bat by, for instance, providing properties such as, but not limited to, optimum damping of vibrations generated by the blade striking the ball. The volume of this non-wood insert may be limited less than 10% of the volume of the entire handle.

The handle may, for instance, be made from Sarawak cane, a wood produced in, for instance, Malaysia. This may be used because it is typically strong and light weight, both qualities that are prized in a cricket bat handle. The non-wood spring component may, for instance, be a substance such as, but not limited to, rubber or cork, or some combination thereof. This non-wood component may be incorporated into the handle using glue such as, but not limited to, woodwork polyvinyl acetate (PVA) glue that may be known by names such as, but not limited to, wood glue, white glue, carpenter's glue, school glue, Elmer's glue or PVA glue.

The handle may also be bound with string (not shown), that may be applied while rotating the bat in a lathe, and may be held in place with PVA glue.

A rubber grip (not shown) may be fitted over the bound bat handle.

FIG. 3 B shows a front perspective view of a cricket law compliant off-set handle bat.

This view once again clearly shows the off-set distance between plane of the striking surface and the front-line of the handle 290, and how it is fabricated along with the V-shaped lower handle 240. The sides of the V-shape of the handle, and the corresponding sides of the V-shape cut out in the blade may be separated by any suitable angle, but in a preferred embodiment, this angle may be 25 degrees or slightly less, as this has been found empirically to provide what may be the optimum surface area and shape for gluing the blade to the handle. The glue used to make this joint may, for instance, be PVC glue, as it may provide a joint of adequate strength at a reasonable cost.

The view of FIG. 3 B also shows the blade 215 of the off-set handle cricket bat. The blade may, for instance, include the back 270, the face or striking surface of the blade 260 and sides of the blade 265.

FIG. 4 A shows a perspective view of an off-set handle bat of a further preferred embodiment of the present invention.

The off-set handle cricket bat 400 may not be compliant with Law 6 and therefore not allowed for use in first-class cricket. Many non-first class variants of cricket are played, ranging from informal games played with a soft ball such as, but not limited to, a tennis ball and which while incorporating many elements of the traditional game of cricket are not subject to the same rules on the materials from which a bat is constructed, or on the dimensions of the components.

The games in which a cricket bat that is non-traditional may be used include cricket variants such as, but not limited to, indoor cricket, street cricket, backyard cricket, beach cricket, modified cricket, such as continuous cricket and French cricket, all of which are described more fully above, and most of which may have no stipulations as to the materials, colors or dimensions of the bat.

The off-set handle cricket bat 400 may, for instance, be constructed from three basic components: a blade 405, a handle 415 and one or more brackets 410 that may secure the handle to the blade. These components may be shaped and sized so that the front line of handle 155 is off-set behind the face or striking surface of the blade 260. This off-set 290 between plane of the striking surface and the front-line of the handle may provide improved and/or optimum batting performance by providing advantages such as, but not limited to, better balance of the bat when held, more power when striking a ball and an effectively faster reaction time of the batsman by having the striking surface ahead of the handle, or some combination thereof.

Each of these components may be made from a variety of different materials of different colors and dimensions, though in a preferred embodiment, these individual components may be sized and shaped to be interchangeable so that they can be mixed and matched according to a user's preferences.

The blade 405 may for instance be made of any suitably strong yet light material such as, but not limited to, wood, willow, solid or hollow aluminum or magnesium alloys and/or other light weight metallic alloys, solid, or hollow, molded or machined plastic, such as, but not limited to, polyethylene terephthalate (PET), polyethylene (PE), high-density polyethylene (HDPE), polyvinyl chloride (PVC), low-density polyethylene (LDPE) polypropylene (PP), polystyrene (PS), high impact polystyrene, polyamides (PA) (Nylons), acrylonitrile butadiene styrene (ABS), polycarbonate (PC), polycarbonate/acrylonitrile butadiene styrene blend (PC/ABS), polyurethanes (PU), or some combination and/or blend thereof, or materials such as carbon or glass fiber, or some combination thereof.

The face or striking surface of the blade 260 may be flat, while the back of the blade 270 may be flat or curved, depending on factors such as cost and strength of the design.

The handle 415 may, for instance, be a solid cylinder or a hollow tube of a suitably strong yet light weight material such as, but not limited to, cane, aluminum, magnesium and/or another light weight metallic alloys, molded or machined plastic, such as, but not limited to, polyethylene terephthalate (PET), polyethylene (PE), high-density polyethylene (HDPE), polyvinyl chloride (PVC) , low-density polyethylene (LDPE) polypropylene (PP), polystyrene (PS),high impact polystyrene, polyamides (PA) (Nylons) , acrylonitrile butadiene styrene (ABS), polycarbonate (PC), polycarbonate/acrylonitrile butadiene styrene blend (PC/ABS), polyurethanes (PU), or some combination and/or blend thereof, or materials such as carbon or glass fiber, or some combination thereof.

The bracket 410 that may be used to secure the handle to the blade, may also be made of any of the materials listed above, or of heavy, but stronger materials such as, but not limited to, steel, stainless steel, copper, bronze, brass or some alloy or combination thereof.

The brackets 410 may be U shaped and may have holes to allow the bracket to be attached to the back of the blade 170.

FIG. 4 B shows a front view of an off-set handle bat 400 that may have a flat face, or striking surface 260, shaped shoulders 210 and an off-set handle 205.

FIG. 4 C shows a back view of an off-set handle bat 400 that may have a back of the blade 270 and one or more brackets 410 that may secure the handle to the blade. In a preferred embodiment, the bracket 410 may fix the handle securely but removably to the blade. This may allow blades made of different materials, of different sizes, of different weights and having different graphics or coloring to be used interchangeable with one handle. It may also allow handles of different lengths, materials, weights and colors to be used interchangeably with a single blade.

FIG. 4 D shows a side view of an off-set handle bat. The handle 415 may be removably attached to the back of the blade 170 in a vicinity of the top or shoulders 110 of the cricket bat. The removable attachment may be means of a bracket 410 that is fixed to the blade by means of a removable attachment element such as, but not limited to, one or more screws 525.

FIG. 4 E shows a close-up, back view of a bracket fixing the handle to the blade.

FIG. 4 F shows a close-up, top view of a bracket fixing the handle 415 to the back of the blade 270. The bracket may have a U-shaped section 420 that may be shaped and sized so that an interior surface has a curvature matched to the curvature of the cylindrical handle 415. The bracket may also have one or more flat wings 425 that may be angled to match the back surface of the blade. The flat wings 425 may also have through holes to allow the bracket to be removably fixed to the back of the blade 170 in a vicinity of the top or shoulders 210 of the bat by a fastening means such as, but not limited to, a bolt 535, a hex-headed screw, a nut on a threaded insert or some combination thereof.

FIG. 5 A shows a perspective view of a perforated off-set handle bat 500.

The off-set bat with weight reducing cut-outs 500 may have the plane of the striking surface off-set in front of the front-line of the handle by a distance 290 that typically is in a range of 1 to 2 cm, and which, in a preferred embodiment corresponds to the thickness of the blade in an upper region of the blade.

The blade of the cricket bat may have one or more cut-outs 510 that may extend the full way through the blade of the bat, or that may be "blind" holes, only extending part way through the blade. Blind holes may be used in order, for instance, to simplify a molding process, or the design of the molds used to make the blades. Such cut-outs may, for instance, be used to reduce, or redistribute, the weight of the bat.

In an embodiment in which the blade is partially or completely hollow, the cut-outs 510 may effectively be tubular connections extending from said striking surface to a back of the blade and may be used to increase the rigidity, stiffness or torsional stiffness of the bat.

FIG. 5 B shows a front view of an exemplary perforated off-set handle bat of the present invention. The weight reducing cut-outs 510 may extend through the full thickness of the blade, or they may be partial cut-outs 520, as shown in the vicinity of the bracket handles so that the handle securing mechanisms 530 may have sufficient material to be attached to.

The weight reducing cut-outs 510 on the striking surface of the blade 260 may be sized to be small compared to the diameter of the ball used in the particular type of cricket the bat is used for. The largest cross-sectional dimension of each of the weight reducing cut-outs 510 may for instance be no more than 0.5 of the diameter of the ball, but is preferably no more than 0.25 of the diameter and in a most preferred embodiment is less than 0.1 of the diameter. This small size of the cut-outs compared with the ball may, for instance, be useful in the bat having a more predictable behavior when striking a ball.

FIG. 5 C shows a back view of a perforated off-set handle bat in one embodiment of the present invention. The off-set handle cricket bat handle 205 may be secured to the back of the blade 270 by means of one or more handle securing mechanisms 530. The back of the blade 270 may have one or more weight reducing cut-outs 510, that may extend through the entire thickness of the bat, or that may only extend part way through the blade. An advantage of having cuts outs that do not extend the full way through the blade is that the striking surface 260 may be kept flat and smooth and the bat may be made lighter.

The blade of the bat may also be hollow and the cut-outs 510, full or partial, may then effectively be tubular connectors and may be used to provide the bat with greater torsional rigidity. With partial cut-outs that are tubular connectors in a hollow bat, the front face of the bat may have a smooth and flat surface that provides a more predicable performance when striking a ball, while the cut-outs may provide torsional rigidity to the bat for more powerful hitting. Such a design may, for instance, be appropriate in bats intended for cricket variants such as, but not limited to, beach or street cricket, in which the ball may be a soft ball such as, but not limited to, a tennis ball, a cricket ball with a softer core, a solid or hollow rubber ball, a nerf ball or some combination thereof. The bats may, for instance, be hollow molded plastic bats that may be made with a minimal amount of material, be light and yet have adequate torsional and flex strength to hit a ball with significant power.

FIG. 5 D shows a side view of a perforated off-set handle bat. The front line 255 of the handle may be off-set by a distance 290 from plane of the striking surface 260.

The off-set handle 205 may be attached to the blade by one or more handle securing mechanisms 530.

FIG. 6 A shows a perspective view of a partially-perforated off-set handle bat 600 in accordance with a further preferred embodiment of the present invention.

As shown in FIG. 6 A, the weight reducing cut-outs 510 may only be located in part of the blade such as, but not limited to, the upper portion of the blade 230. Such an arrangement may allow the off-set handle cricket bat lower portion of the blade 235 to have a smooth striking surface for more predictable striking of the ball. The partial cut out arrangement may also be used to alter the weight distribution of the bat and/or the flexure characteristics of the bat, either or both of which may improve the performance of the bat when used to strike a ball.

FIG. 6 B shows a front view of a partially-perforated off-set handle bat 600. The weight reducing cut-out 510 may for instance be only in the upper portion of the blade 230, leaving the lower portion of the blade 235 of the cricket bat flat and smooth. The off-set handle cricket bat handle 205 is also shown.

FIG. 6 C shows a back view of a partially-perforated off-set handle cricket bat 600. The off-set handle cricket bat handle 205 may, for instance, be connected to the blade by one or more handle securing mechanisms 530. In a preferred embodiment, the handle securing mechanism 530 may be designed for easy removal so that blades and handles may be easily interchanged, allowing for easily customizable bats that may be assembled to an individual's preferences such as, but not limited to, color, design, size, shape or weight, or some combination thereof.

As discussed previously, the cut-outs 510 may perform functions such as, but not limited to, weight reduction, weight re-distribution, increasing the rigidity of otherwise hollow bats, as the cut-outs 510 are then effectively tubular support structures connected the front and the back of the blade, or for aesthetic purposes, or some combination thereof.

The cut-outs 510 may also be blind cut-outs or tubular supports, particularly in a vicinity of the handle securing mechanism 530 so as to allow sufficient material for items such as, but not limited to, screws, bolts, threaded inserts, or some combination thereof, to be securely fixed to the blade.

FIG. 6 D shows a side view of a partially-perforated off-set handle bat 600 of the present invention. The off-set distance 290 between plane of the striking of the blade 260 and the front-line of the handle 255 is preferably in a range of 1-2 cm, and may be equivalent to the thickness of the blade.

Figure 7:
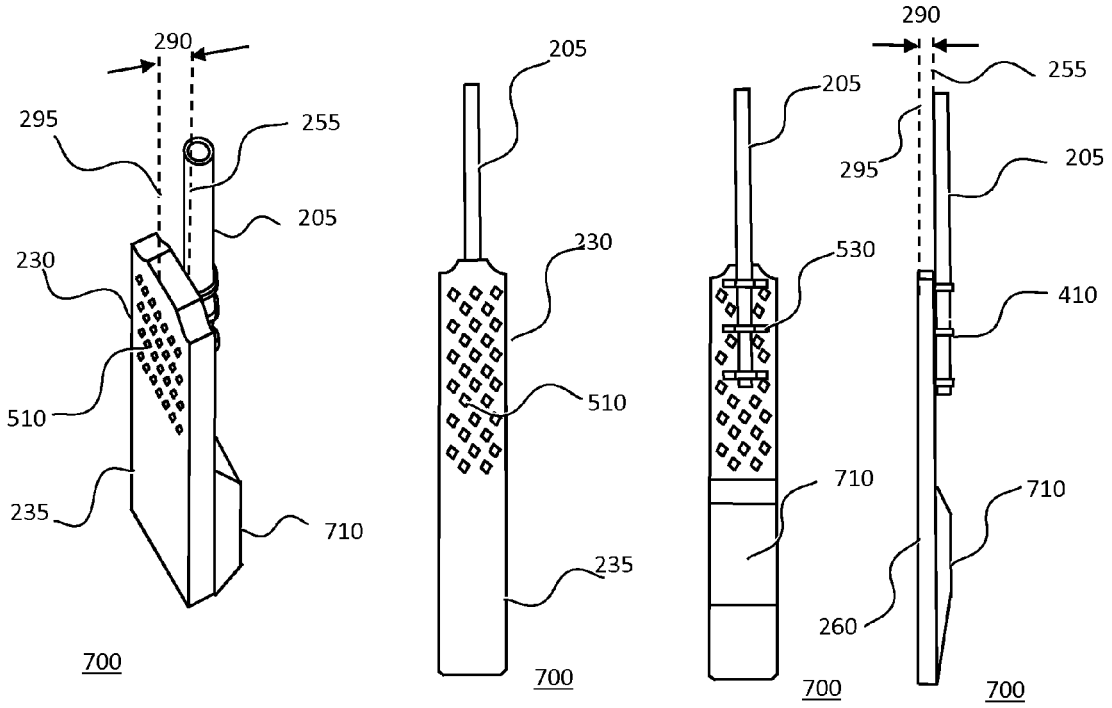
FIG. 7 A shows a perspective view of a thickened lower blade off-set handle bat.

FIG. 7 A shows a perspective view of a thickened lower blade off-set handle bat 700.

A thickened lower blade off-set handle bat 700 may, in addition to the front-line of the handle 255 off-set by a distance 290 behind the plane 295 of the striking surface 295, have a thickened lower blade 710. Such a thickened lower blade 710 may, for instance, improve the performance of the cricket bat by allowing the adjustment of characteristics such as, but not limited to, the weight distribution of the bat, a lowering of the center of gravity of the bat, an increase in strength or rigidity of lower portion of the blade 235, allowing for a thickness of the upper portion of the blade 230 to be tailored to the off-set distance 290 between plane of the striking surface and the front-line of the bat's handle 205, or some combination thereof.

FIG. 7 B shows a front view of a thickened lower blade off-set handle bat 700. In this view the bat is shown as having cut-outs 510 in an upper portion of the blade 230, but not in the lower portion of the blade 235. Such an arrangement may be advantageous allowing the adjustment of characteristics such as, but not limited to, the weight distribution of the bat, a lowering of the center of gravity of the bat, an increase in strength or rigidity of the upper portion of the blade 230 when, for instance, the cut-outs 510 function as tubular connectors in an otherwise hollow bat, or some combination thereof.

FIG. 7 C shows a back view of a thickened lower blade off-set handle bat 700. This view shows the thickened lower blade 710 as well as the handle securing mechanisms 530 that may act to removably secure the off-set handle 205.

FIG. 7 D shows a side view of a thickened lower blade off-set handle bat 700 in which the lower portion of said blade may be of greater thickness than said upper portion of the blade.

The off-set distance 290 between the plane 295 of the striking surface and the front-line of the handle 205 may be equal to the thickness of the upper portion of the blade. The handle 205 may be secured to the blade 410 by, for instance, a bracket that may be fixed in place by items such as, but not limited to, screws, bolts, studs or some combination thereof.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed:

1. A device for striking a ball, comprising:

a cricket bat, said cricket bat further comprising:

a blade having a substantially flat striking surface and said blade measuring 10.8 cm or less in width, and at least 1 cm in depth throughout the length of the striking surface and a substantially concave, none-striking side shaped to be symmetrical about a first plane running from the top to the bottom of the blade along a midline of the striking surface and oriented normal to said striking surface;

a cylindrically shaped handle rigidly but removably attached to an upper portion of said blade such that a total length of said blade and attached handle is 96.5 cm or less, and said handle is 52% or less of the length of the combined handle and blade; and wherein a front line of said handle is situated on said first plane and behind a second plane, said second plane being the plane of said striking surface, by at least 1 cm and wherein said handle is attached to said blade such that said front line of said bat is located adjacent and parallel to a back surface of an upper portion of said blade.

2. The cricket bat of claim 1 wherein said blade comprises one or more cut outs extending from said striking surface to a back of said blade.

3. The cricket bat of claim 2 wherein said cutouts are located in an upper portion of said blade and said lower portion of said blade is solid.

4. The cricket bat of claim 3 wherein said lower portion of said blade is of greater thickness than said upper portion of said blade.

5. The cricket bat of claim 1 wherein said attachment of said handle to said blade comprises one or more bracket elements removably attached to said back surface of said blade.

6. The cricket bat of claim 1 wherein said blade is partially hollow and comprises one or more tubular connections extending from said striking surface to a back of said blade.

* * * * *